US007633024B1

(12) United States Patent
Gibboney, Jr.

(10) Patent No.: US 7,633,024 B1
(45) Date of Patent: Dec. 15, 2009

(54) PUSH ROD SHUNT FOR LIGHT STRING SOCKETS

(75) Inventor: James W. Gibboney, Jr., Conyers, GA (US)

(73) Assignee: Tech Patent Licensing, LLC, St. Augustine, FL (US)

( * ) Notice: Subject to any disclaimer, the term of this patent is extended or adjusted under 35 U.S.C. 154(b) by 0 days.

(21) Appl. No.: 12/417,721

(22) Filed: Apr. 3, 2009

Related U.S. Application Data

(60) Provisional application No. 61/058,249, filed on Jun. 3, 2008.

(51) Int. Cl.
*H01R 33/96* (2006.01)

(52) U.S. Cl. ..... 200/51.1; 439/188; 315/122

(58) Field of Classification Search ..... 200/51.1, 200/51.09, 51 R; 439/188, 513, 699.2, 619; 315/122, 119
See application file for complete search history.

(56) References Cited

U.S. PATENT DOCUMENTS

| | | | | |
|---|---|---|---|---|
| 348,875 | A | | 9/1886 | Wightman et al. |
| 975,090 | A | | 11/1910 | Wappler |
| 1,536,332 | A | | 5/1925 | Dam |
| 3,294,932 | A | | 12/1966 | Barlow |
| 3,345,482 | A | | 10/1967 | Lou |
| 3,359,523 | A | | 12/1967 | Lou |
| 3,512,043 | A | * | 5/1970 | Jaaksoo et al. ..... 200/51.1 |
| 4,233,543 | A | | 11/1980 | Hickok |
| 4,350,407 | A | | 9/1982 | Tong |
| 4,644,451 | A | | 2/1987 | Chabria |
| 4,654,766 | A | | 3/1987 | Tung |
| 4,894,499 | A | | 1/1990 | Beck et al. |
| 4,991,071 | A | | 2/1991 | Braasch |
| 5,139,343 | A | | 8/1992 | Lin |
| 6,257,740 | B1 | | 7/2001 | Gibboney |
| 6,533,437 | B1 | | 3/2003 | Ahroni |
| 6,583,536 | B1 | | 6/2003 | Gibboney |
| 7,253,556 | B1 | | 8/2007 | Gibboney |
| 7,264,392 | B2 | | 9/2007 | Massabki et al. |
| 7,449,643 | B2 | | 11/2008 | Nakade |
| 7,453,194 | B1 | | 11/2008 | Gibboney |
| 7,473,024 | B2 | | 1/2009 | Gibboney |
| 7,484,995 | B2 | | 2/2009 | Ding |
| 2003/0156412 | A1 | | 8/2003 | Limber et al. |
| 2003/0214212 | A1 | | 11/2003 | Gibboney, Jr. |

(Continued)

FOREIGN PATENT DOCUMENTS

| | | |
|---|---|---|
| GB | 1164257(A) | 9/1969 |

(Continued)

*Primary Examiner*—Felix O Figueroa
(74) *Attorney, Agent, or Firm*—Michael A. Mann; Nexsen Pruet, LLC

(57) ABSTRACT

A shunt for use in a socket of a string of lights resides in an otherwise typical lamp of a string of lights. The present shunt is a conductive spring held in position by a shunt housing between the two conductive terminals so that both of its curved lateral ends contact the terminals when the bulb holder is removed. When the bulb holder is inserted, a pushrod on the flat central portion of the conductive spring presses the spring down into a well in the shunt housing so that the curved lateral ends of the conductive spring are drawn away from the electrical terminals, thereby allowing current to flow through the Dumet wires to the filament.

11 Claims, 4 Drawing Sheets

U.S. PATENT DOCUMENTS

| | | | |
|---|---|---|---|
| 2006/0207866 | A1 | 9/2006 | Bonn et al. |
| 2007/0001058 | A1 | 1/2007 | Severson |
| 2007/0297196 | A1 | 12/2007 | Massabki et al. |
| 2008/0129176 | A1 | 6/2008 | Jigamian |

FOREIGN PATENT DOCUMENTS

| | | |
|---|---|---|
| JP | 2006196241(A) | 7/2006 |

* cited by examiner

PUSH ROD SHUNT FOR LIGHT STRING SOCKETS

CROSS REFERENCE TO RELATED PATENTS

The priority benefit of U.S. provisional patent application Ser. No. 61/058,249 filed Jun. 3, 2008, which is incorporated herein by reference, is claimed.

BACKGROUND OF THE INVENTION

The present invention relates to light strings such as those used for holiday lighting and, more particularly, to shunts in the sockets of the lights in the string.

Strings of lights are typically wired electrically in series. Consequently, when one light in the string burns out or is removed, all the lights in the string go out. Determining which light needs to be replaced is tedious. If the string has 50 or more lights and the string is attached to a Christmas tree, finding the burned out or missing bulb can be very tedious.

For a number of years, this problem has been solved, or at least avoided, by the use of shunts that allow current to pass directly between the terminals of the defective lamp, bypassing the missing or defective bulb filament. Passing electrical current from one lamp to the next regardless of the condition of the bulb in any individual lamp allows the remaining lamps to continue to operate.

Shunts are typically found in two places in prior art lamps, namely, in the glass bulb and in the socket. The shunts inside the glass bulb are typically coils of wire wrapped around the conductive elements (called Dumet wires). When the filament fails, the oxide coating on the coils of wire that theretofore prevented direct conduction of electricity is burned off and the coil welds itself to the Dumet wires, thereby providing a new electrically conductive path for passing the electrical current.

Of the type of shunt that is located in the socket, there are two types, namely, solid state shunts and mechanical shunts. Among the mechanical shunts, for example, there is a set of spring contact terminals that is the subject of U.S. Pat. No. 6,257,740. These spring contacts are pushed apart when the bulb holder is inserted into the socket and spring back together when the bulb holder is removed, thereby allowing the current to pass from one terminal to the other directly. This type is strictly for use when the bulb (and its bulb holder) is removed and does not address the issue of a burned out bulb. This type of shunt works well and has enjoyed commercial success.

Another mechanical shunt is disclosed in U.S. Pat. No. 7,253,556, which is invented by the present inventor and is commonly owned by applicant. This mechanical shunt is a nearly horizontal flat strip of metal held in place between the two electrical terminals in a light socket by a shunt holder. The ends of the shunt extend laterally and slightly downwardly to engage the electrical terminals on the socket wall. When the bulb holder, which is hollow, is inserted into the socket, the shunt holder together with the shunt is received inside the hollow bulb holder, and, as the shunt enters the bulb holder, its ends are bent down and away from the electrical terminals, thereby allowing electrical current to pass to and through the Dumet wires and thence to the filament in the bulb rather than directly through the shunt.

Note with respect to both of the mechanical shunts just described, that a special structural feature of the bulb holder portion of the lamps interacts with the shunt. While forming all the bulb holders of a given string of lights with the structural feature is not a problem, it can present a problem when the user either needs to replace a lamp having the special structural feature with an ordinary lamp or desires to replace the lamp with a lighted ornament. There are, for example, so-called pigtail ornaments, such as that described in U.S. Pat. No. 6,764,205, issued to Peloquin. This type of ornament contains a light or other electrical load (e.g., sound emitting device or motor) that is connected to a cord (or "pigtail"), the distal end of which has a plug that is inserted into a socket of a light string to power the ornament. The plug of the ornament is typically shaped much like a bulb holder. Because the connector on the end of the pigtail does not have the special structure needed to activate the mechanical shunt, these types of ornaments are operated without the shunt protection or cannot be operated because the shunt is never deactivated and the ornament is not energized. This presents a convenience issue to the user.

There are a huge number of light strings manufactured and sold each year throughout the world. The number is so large that even small changes that, for example, reduce material requirements, simplify manufacturing, or improve safety, reliability, or compatibility make a huge difference in the costs to manufacture. Accordingly, there remains a need for a better mechanical shunt for use in the sockets of the lamps of light strings.

SUMMARY OF THE INVENTION

According to its major aspects and briefly recited, the present invention is a mechanical shunt for use in a socket of a string of lights. The shunt enables the current to by-pass the filament and flow to the opposing terminal in the socket when the lamp is removed from the socket. The present shunt resides in an otherwise typical-looking lamp socket of a string of lights having plural lamps electrically interconnected in series by insulated, conductive wires. Each lamp has a bulb with a coiled filament running between a pair of wires. These wires, called Dumet wires, extend from inside the bulb to its outside. The bulb is secured to a bulb holder and the Dumet wires extend through at least one hole formed in the bulb holder. Once they emerge from the at least one hole in the bulb holder, the Dumet wires are bent back against the outside of the bulb holder.

The bulb holder fits removably into a socket that has two electrical terminals mounted opposite each other on the interior wall of the socket. When the bulb holder is inserted, the Dumet wires on the outside of the bulb holder contact the two electrical terminals on the interior wall of the socket and then pass current, when the terminals are energized, to the filament inside the bulb. These electrical terminals receive electrical current from two insulated wires entering the bottom of socket and coming from either the adjacent lamps in the light string or the 120V connectors at the ends of the light string.

Two alternative paths for the electrical current thus exist depending on whether the light and bulb holder are in the socket or not. The first path runs from the first of the two insulated wires to the first of the two electrical terminals and thence to the first of two Dumet wires and on to the filament, returning through the second of the two Dumet wires, the second of the electrical terminals and finally to the second insulated wire. When the light is removed from the socket, the first electrical terminal rather than being able to pass the current to the first Dumet wire, passes it instead through the shunt to the second electrical terminal and then to the second insulated wire.

The present socket includes a shunt housing inserted in the bottom center of the socket. The shunt housing has a well therein and a push rod is dimensioned to be received in the well. The socket also includes a V-shaped conductive spring with a central portion and two lateral ends that are shaped to reach to the electrical terminals so that it can pass current between them when the lamp is not in the socket. The conductive spring is carried in a race in the shunt housing and passes through the well. The push rod in the well rests on the conductive spring. When the lamp is inserted into the socket, its bulb holder will press down on the pushrod which, in turn, presses down on the central portion of the conductive spring pushing the central portion of the conductive spring further down into the well and causing the lateral ends of the conductive spring to be drawn away from the electrical terminals in favor of the electrical path through the filament. Thus the pushrod and shunt housing substitute for specialized structure on the bottom of the bulb holder; an ordinary, prior art bulb holder will be able to engage the pushrod and operate the shunt.

The push rod is thus an important feature of the present invention. It avoids the need for a specialized bulb holder and allows ordinary bulb holders to be used with the present socket and still deactivate the shunt when the ordinary bulb holder is being used. In addition, the push rod shunt feature allows powered ornaments, including those with a pig-tail wire extending therefrom, to be used with the present socket and still deactivate the shunt.

The interaction between the conductive spring and its shunt housing is another important feature of the present invention. The spring has a flat center so as to receive the push rod and laterally curved ends that normally reach the two electrical terminals on the interior wall of the socket. However, when the pushrod depresses the conductive spring deeper into the well of the shunt housing, the lateral ends are pulled away from the terminals, to break contact.

The interaction of the bulb holder with the push rod relative to the Dumet wires on the outsides of the bulb holder and the terminals on the inside of the socket is another important feature of the present invention. The bulb holder begins to engage the push rod after contact is made between the Dumet wires and the terminals, and releases the push rod before the Dumet wires disengage from the terminals. This relative timing assures that the next electrical path is in place before the first is terminated, thereby preventing arcing.

These and other features and their advantages will be apparent to those skilled in the art of light string electrical design from a careful reading of the Detailed Description of Embodiments accompanied by the following drawings.

DETAILED DESCRIPTION OF THE INVENTION

The present invention is socket with a mechanical shunt for use with a lamp in a string of lights. The shunt switches the flow of the electrical current from a first path leading between the electrical terminals in the socket to the filament in the bulb to a second path that bypasses the filament and allows the electrical current to flow from one electrical terminal to the other through the shunt. The path the electrical current takes depends on whether the lamp is present in the socket or not. The term "light string" refers to plural, spaced-apart lights connected in series by insulated electrical wiring. A light string will have an electrical plug at one end and a receptacle at the other end with the plural lights in an electrical series therebetween. The term "light" refers to a lamp and the socket and insulated wiring to which it is connected. The term "lamp" refers to the combination of a bulb with Dumet wires in a bulb holder.

Figure 1:
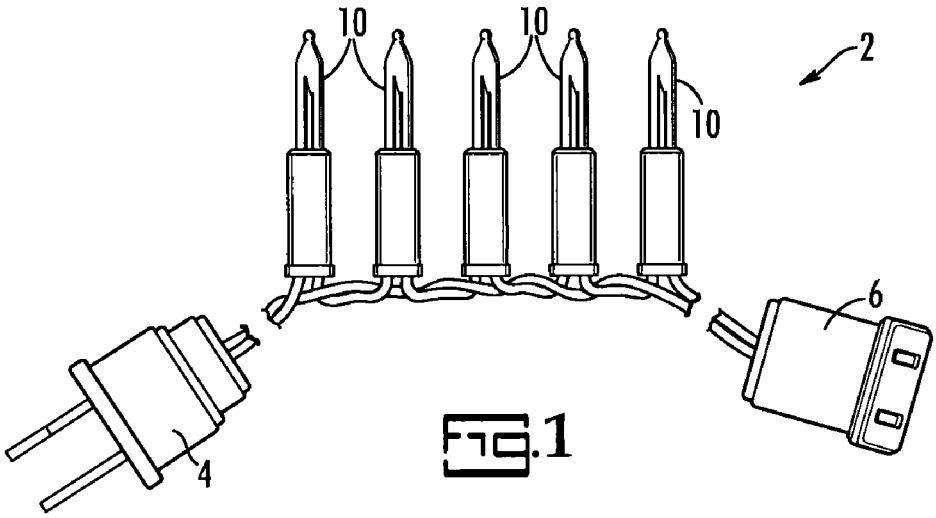
FIG. 1 is a side view of a light string according to one embodiment of the present invention.
Figure 2:
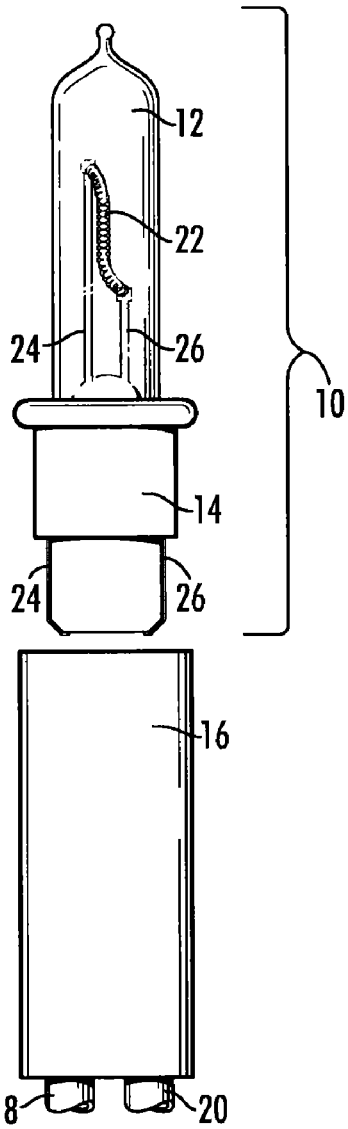
FIG. 2 is an exploded side view of a single lamp and socket from the light string shown in FIG. 1.

FIG. 1 shows an abbreviated string of lights 2 with five lamps 10 joined in series with a plug 4 at one end and a receptacle 6 at the other end. FIG. 2 illustrates a lamp 10 and socket 16, in a side view. Lamp 10 includes a bulb 12, a bulb holder 14, Dumet wires 24 and 26, and filament 22. Bulb 12 is a partially evacuated transparent glass housing. Lamp 10 is removably seatable in socket 16. Two insulated electrical wires, first insulated wire 18 and second insulated wire 20, extend from socket 16 and are connected to the adjacent sockets in the series of sockets of the light string or the connectors 4 and 6 at the ends of the light string 2 (FIG. 1). Dumet wires 24 and 26 extend from the interior of bulb 12 to the exterior of bulb holder 14 through at least one hole in bulb holder 14.

Figure 3A:
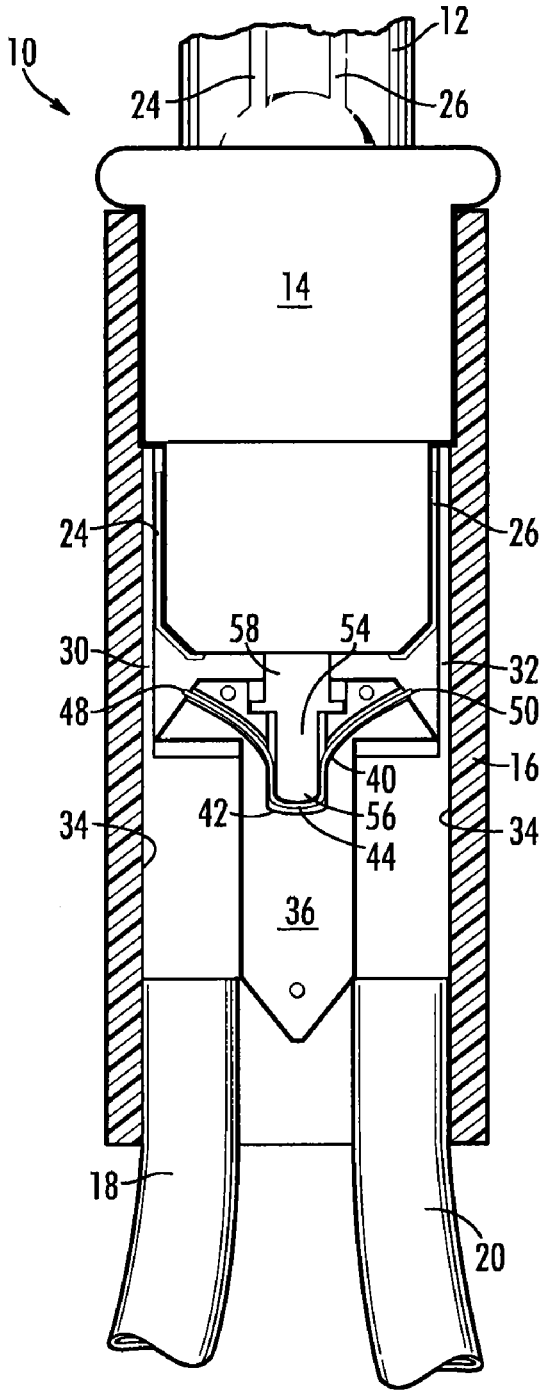
FIG. 3A is a cross-sectional view of the socket shown in FIG. 2 with the lamp shown inserted into the socket and showing the mechanical shunt assembly with the push rod depressed and the lateral ends of the shunt withdrawn inside of the shunt housing, according to one embodiment of the invention.
Figure 3B:
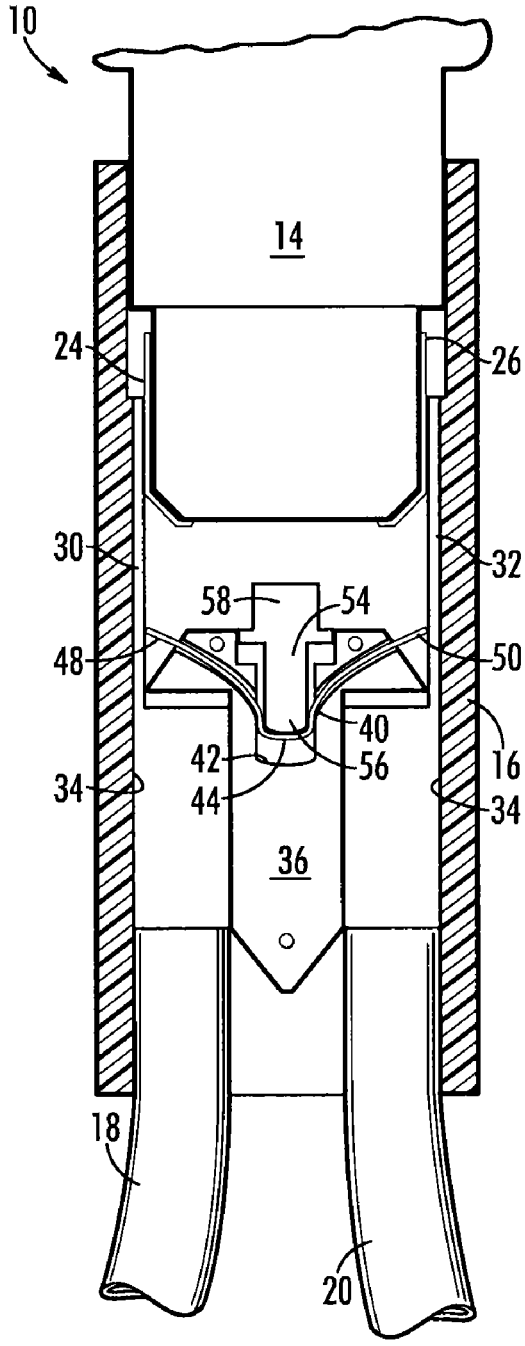
FIG. 3B is a cross-sectional view similar to that of FIG. 2 but with the lamp shown partially pulled out of the socket and showing the mechanical shunt assembly with the push rod released and the lateral ends of the shunt contacting the two electrical terminals inside the socket, according to one embodiment of the present invention.

FIGS. 3A and 3B are both cross-sectional views of a lamp 10 in a socket 16 according to one embodiment of the present invention. It can be seen in both FIGS. 3A and 3B that Dumet wires 24 and 26, after exiting the bottom of bulb holder 14, are folded back against the sides of bulb holder 14 in order to be in a position to make contact with a first and opposing second electrical terminals 30 and 32 on the interior wall 34 of socket 16. FIG. 3A shows a lamp 10 according to one embodiment of the present invention with the bulb holder 14 fully seated in socket 16 and with electrical current flowing to the filament 22 (FIG. 2), as further explained below. FIG. 3B, in contrast, shows the lamp 10 of the present invention with bulb holder 14 partially removed from socket 16 and with electrical current flowing through a conductive spring 40, as further explained below.

Within socket 16 is a shunt housing 36 centered between electrical terminals 30 and 32. Shunt housing 36 is generally T-shaped with the vertical portion of the T inserted into the bottom of socket 16 to help keep first and opposing second insulated wires 18 and 20 apart. The top of the T-shaped shunt housing 36 insulates the conductive spring 40 from the ends of insulated wires 18 and 20 and provides a well 42 for receiving conductive spring 40. Conductive spring 40 is symmetric left to right and has a flat central portion 44 and first and opposing second curved lateral ends 48 and 50. First and opposing second lateral ends 48 and 50 are dimensioned to extend to electrical terminals 30 and 32 when conductive spring 40 is placed in well 42 but no appreciable force is applied to it. The central portion 44 of conductive spring 40, without a force (a force much more than its own weight), does not rest on the bottom of well 42 but rather somewhat above it.

In addition to conductive spring 40, shunt housing 36 holds a pushrod 54 that rests on the flat central portion 44 of conductive spring 40. Even with pushrod 54 on conductive spring 40, the first and second curved lateral ends 48 and 50, engage first and second terminals 30 and 32. Pushrod 54 has a flat bottom 56 that is dimensioned to rest on central portion 44 of conductor spring 40 and a flat top 58 that is dimensioned to engage the bottom of bulb holder 14. As shown in FIG. 3A, as bulb holder 14 is inserted into socket 16, the bottom of bulb holder 14 engages top 58 of pushrod 54 pressing it down on central portion 44 of conductive spring 40. As it pushes conductive spring 40 down, the lateral ends 48 and 50 are drawn away from first and second terminals 30 and 32 thereby shorting the first electrical path directly from first terminal 30 through conductive spring 40 to second terminal 32 in favor of the second conductive path through Dumet wires 24 and 26 and filament 22. As shown in FIG. 3B, removing bulb holder 14 from socket 16 releases pushrod 54 and relieves conductive spring 40 so that its first and second curved lateral ends 48 and 50 once again engage first and second electrical terminals 30 and 32, respectively, and allow current to flow through conductive spring 40 instead of into Dumet wires 24 and 26 and into filament 22.

Figure 4:
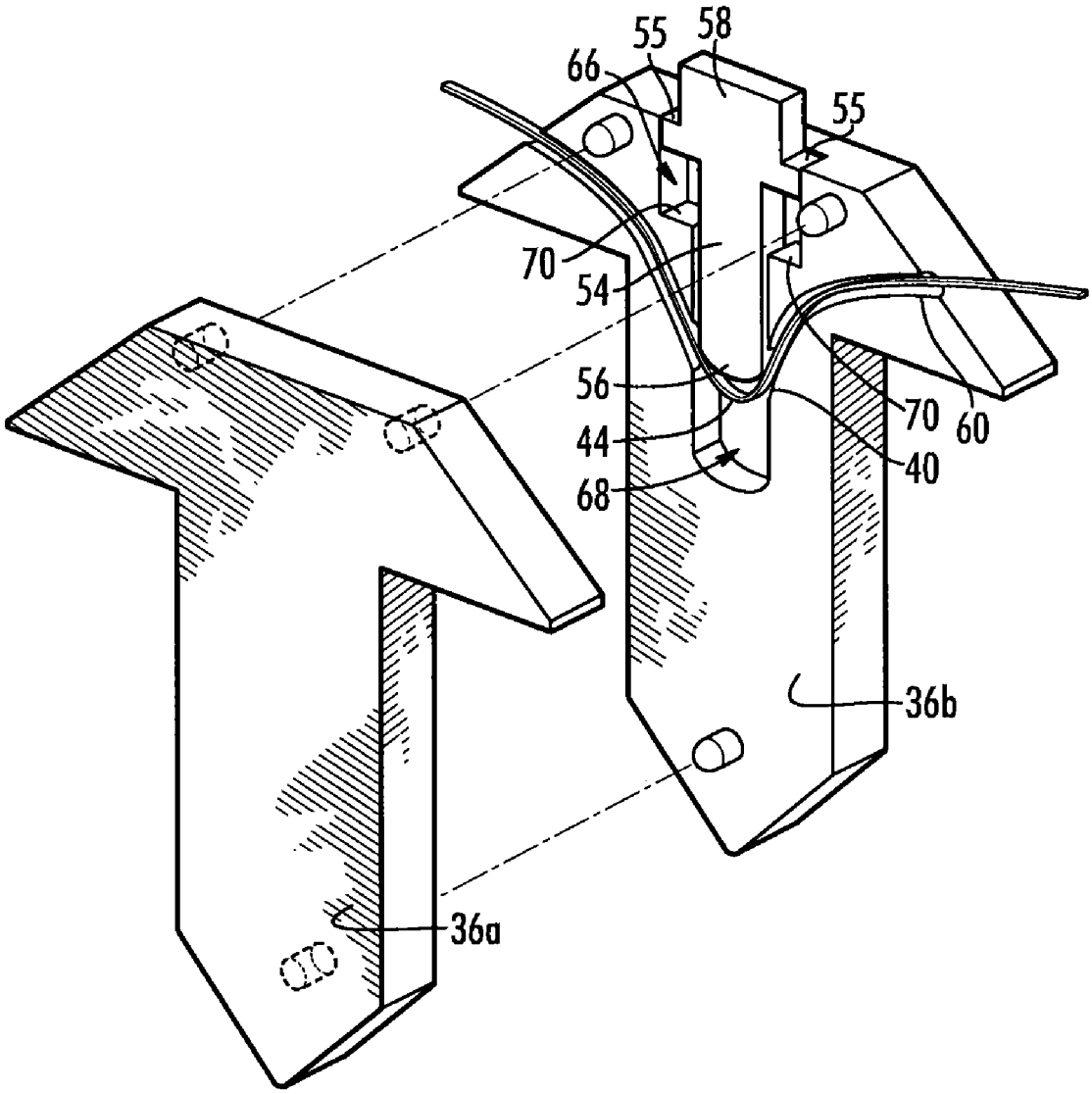
FIG. 4 is an exploded, perspective, detail view of the shunt assembly, according to one embodiment of the present invention.

FIG. 4 is an exploded perspective view of a two-piece shunt housing 36*a* and 36*b* according to one embodiment of the present invention. Note that, in this particular embodiment, the two pieces of the shunt housing 36*a* and 36*b* are not identical. Specifically, the mating surface of shunt housing piece 36*b* has a well 42 for pushrod 54 and a chase 60 for the conductive spring 40. The corresponding piece 36*a* of the shunt housing does not have these features but instead, when placed against housing piece 36*b*, prevents pushrod 54 and conductive spring 40 from exiting the well 42 and the chase 60, respectively. Note also that the well 42 can have an upper larger dimensioned portion 66 and a lower, reduced dimension portion 68. The point at which these two portions meet creates a shoulder 70. The push rod 58, more over, can have a flange 55 that is dimensioned to fit into the larger dimensioned portion 66 of the well 42 but not the reduced dimension portion 68. The shoulder 70 acts as a stop for the push rod 58.

Another feature of the present invention is that the shunt is activated and deactivated without arcing. Referring again to FIGS. 3A and 3B, when bulb holder 14 is removed, first and second Dumet wires 24 and 26 do not lose contact with first and second electrical terminals 30 and 32 until first and second lateral ends 48 and 50 have engaged first and second electrical terminals 30 and 32. Similarly, as bulb holder 14 is inserted into socket 16, first and second Dumet wires 24 and 26 engage first and second electrical terminals 30 and 32 before first and second lateral ends 48 and 50 are disconnected from first and second electrical terminals 30 and 32 for the same reason, namely, to prevent arcing.

Figure 5:
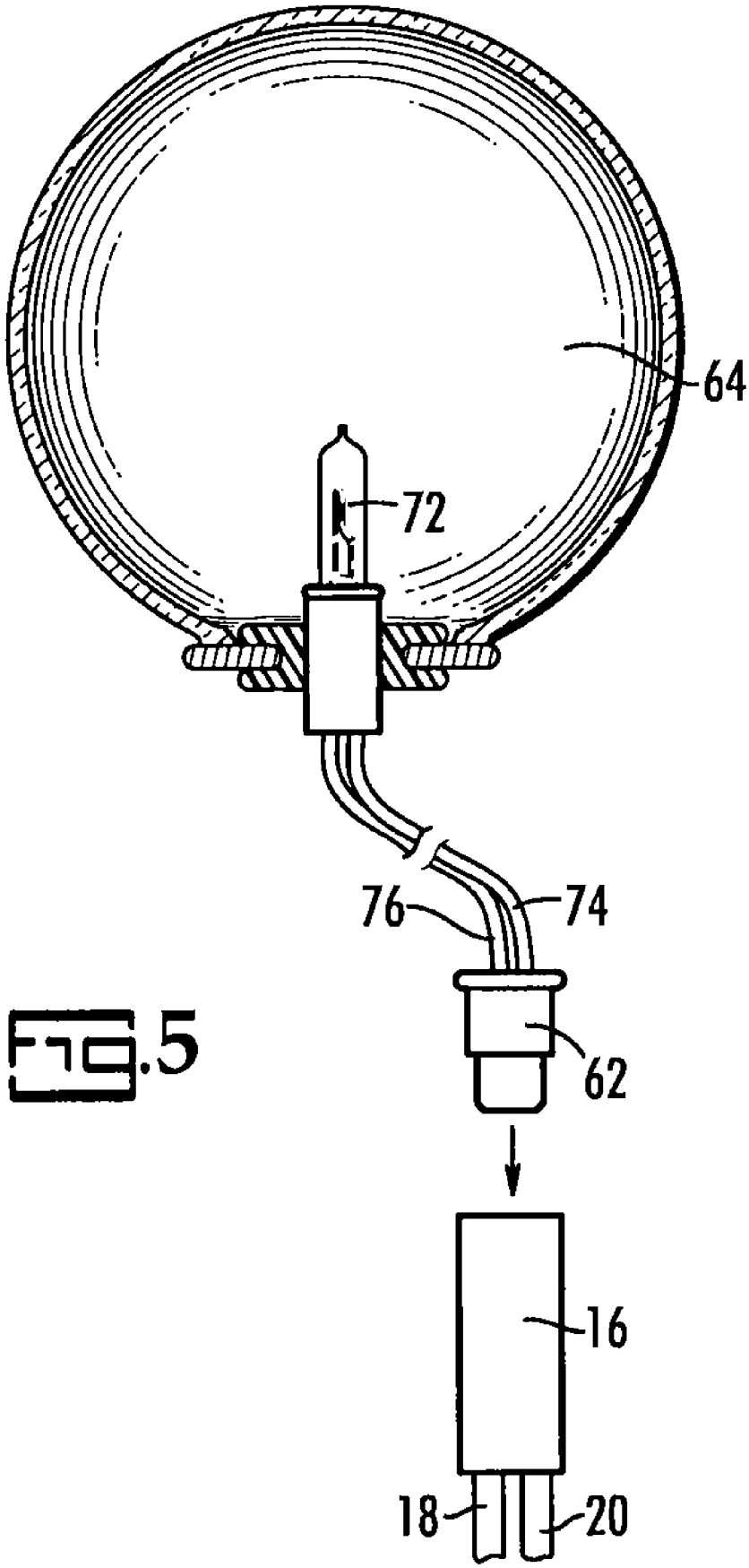
FIG. 5 is a cross-sectional view of a so-called pigtail ornament connected to the present socket with mechanical shunt, according to one embodiment of the present invention.

Importantly, bulb holder 14 need not be a specially formed bulb holder, that is, it need not have any special physical features that are designed to engage pushrod 54. Accordingly, a standard replacement bulb will operate the present conductive spring 40 as a shunt. In addition, a pigtail adaptor with a plug 62 from an ornament 64 with an electrical load 72, as seen in FIG. 5, can be removably inserted into socket 16 and have the same effect as bulb holder 14. That is, the plug 62, which can be shaped like a standard bulb holder, engages top 58 of push rod 54, pressing the push rod 54 deeper into the well 42 and thereby drawing the ends 48 and 50 of conductive spring 40 from first and second terminals 30 and 32. The wires 74 and 76, which exit the bottom of plug 62 and which are in electrical communication with the load 72 and the plug 62, engage the terminals 30 and 32 inside the socket 16. Thereby, when the string is energized, ornament 64 is energized.

Although the load 72 in FIG. 5 is a light, the load can also be, for example, a device that makes a sound, a motor, or some other electronic load. A light string of the present invention could also be sold with more sockets 16 than bulbs 12 for the purpose of accommodating the plug 62 of an ornament 64. If the pigtail adaptor plug 62 should inadvertently fall out or be pulled out of socket 16, conductive spring 40 (FIG. 3B) will re-engage and current will pass to the adjacent lights in the string.

It is intended that the scope of the present invention include all modifications that incorporate its principal design features, and that the scope and limitations of the present invention are to be determined by the scope of the appended claims and their equivalents. It also should be understood, therefore, that the inventive concepts herein described are interchangeable and/or they can be used together in still other permutations of the present invention, and that other modifications and substitutions will be apparent to those skilled in the art from the foregoing description of the various embodiments without departing from the spirit or scope of the present invention.

What is claimed is:

1. A light for use in a light string, said light comprising:

a bulb;

a filament in said bulb;

a bulb holder carrying said bulb, said bulb holder having at least one hole formed therein;

a first and a second wire extending from said filament inside said bulb through said at least one hole;

a socket carrying said bulb holder, said bulb holder being removably seatable in said socket, said socket having an interior wall;

a first and an opposing second electrical terminal carried by said interior wall of said socket, said first and said second wires engaging said first and said second electrical terminals, respectively, when said bulb holder is seated in said socket;

a shunt housing carried by said socket between said electrical terminals, said shunt housing having a well formed therein;

a push rod carried by said shunt housing and dimensioned to fit into said well of said shunt housing;

a conductive spring carried by said shunt housing and having a first lateral end, an opposing second lateral end, and a central portion, said central portion being positioned in said well, said push rod being carried on said central portion so that, when said bulb holder is not seated in said socket so as to push down on said push rod, said first and second lateral ends of said conductive spring are in contact with said first and second electrical terminals, respectively, whereby electrical current flows from said first electrical terminal to said second electrical terminal through said conductive spring, and, when said bulb holder is inserted into said socket, said bulb holder pushes said push rod against said central portion of said conductive spring thereby pushing said central portion deeper into said well so that said first and second lateral ends are drawn away from said first and second electrical terminals whereupon electrical current flows from said first and second electrical terminals through said first and second wires, respectively, and thence through said filament;

wherein said well has an upper, larger dimensioned portion and a lower, reduced dimension portion defining a shoulder where said larger dimensioned portion meets said reduced dimension portion, and wherein said push rod has a flange, said flange being dimensioned to fit into said larger dimensioned portion but not said reduced dimension portion so that said shoulder acts as a stop for said push rod when said bulb holder is inserted into said socket.

2. The light as recited in claim 1, wherein said first and said second lateral ends of said conductive spring are curved.

3. The light as recited in claim 1, wherein said shunt housing has a first part and a second part, said first part having said well formed therein.

4. The light as recited in claim 3, wherein said first part has a chase formed therein for said conductive spring.

5. The light as recited in claim 1, wherein said push rod and said conductive spring are dimensioned so that, when said bulb holder is inserted into said socket, said first and second wires contact said first and second electrical terminals before said first and second lateral ends are drawn away from said first and second electrical terminals, and, when said bulb holder is removed from said socket, said first and second lateral ends contact said first and second electrical terminals before said first and second wires lose contact with said first and second electrical terminals.

6. A light string, said light string comprising:

a plurality of lamps, said each of said plurality of lamps having a bulb;

a filament in said bulb;

a bulb holder carrying said bulb, said bulb holder having at least one hole formed therein; and a pair of electrical wires running from said filament in said bulb through said at least one hole of said bulb holder and extending outside said bulb holder;

a plurality of sockets arranged in an electrical series and connected by electrical conductors, said plurality of lamps being removably seatable in said plurality of sockets with said plurality of sockets exceeding in number said plurality of lamps by at least one socket, each socket of said plurality of sockets having an interior wall and having a first and an opposing second electrical terminal carried by said interior wall of said each socket, said first and said second wires engaging said first and said second electrical terminals, respectively, when said bulb holder is seated in said each socket;

a shunt housing carried by said each socket between said electrical terminals, said shunt housing having a well formed therein;

a push rod carried by said shunt housing and dimensioned to fit into said well of said shunt housing;

a conductive spring carried by said shunt housing and having a first lateral end, an opposing second lateral end, and a central portion, said central portion being positioned in said well, said push rod being carried on said central portion so that, when said bulb holder is not seated in said each socket so as to depress said push rod, said first and second lateral ends of said conductive spring are in contact with said first and second electrical terminals, respectively, whereby electrical current flows from said first electrical terminal to said second electrical terminal through said conductive spring, and, when said bulb holder is inserted into said each socket, said bulb holder pushes said push rod against said central portion of said conductive spring thereby pushing said central portion deeper into said well so that said first and second lateral ends are drawn away from said first and second electrical terminals whereupon electrical current flows from said first and second electrical terminals through said first and second wires, respectively, and thence through said filament;

wherein said well has an upper, larger dimensioned portion and a lower, reduced dimension portion defining a shoulder where said larger dimensioned portion meets said reduced dimension portion, and wherein said push rod has a flange, said flange being dimensioned to fit into said larger dimensioned portion but not said reduced dimension portion so that said shoulder acts as a stop for said push rod when said bulb holder is inserted into said socket.

7. The light string as recited in claim 6, further comprising:

at least one ornament, said ornament comprising:

an electrical load;

a plug dimensioned to be received in said socket, said plug having at least one hole formed therein; and a pair of wires in electrical connection with said electrical load and said plug, said pair of wires running through said at least one hole in said plug and extending outside said plug so that said wires engage said first and second electrical terminals on said interior wall of said each socket so that, when said light string is energized, said ornament is energized.

8. The light string as recited in claim 7, wherein said load is a light.

9. The light string as recited in claim 7, wherein said load makes a sound.

10. The light string as recited in claim 7, wherein said load is a motor.

11. A device for use with an ornament, said ornament having a plug and an electrical load and said plug having at least one hole formed therein and a first and a second wire extending from said at least one hole, said first and second wires in electrical connection with said plug and said electrical load, said device comprising:

a socket dimensioned to receive said plug, said plug removably seatable in said socket, said socket having an interior wall;

a first and an opposing second electrical terminal carried by said interior wall of said socket, said first and said second wires of said plug engaging said first and said second electrical terminals, respectively, when said plug is seated in said socket;

a shunt housing carried by said socket, said shunt housing having a well;

a push rod being dimensioned to fit into said well of said shunt housing;

a conductive spring carried by said shunt housing and having a first lateral end, an opposing second lateral end, and a central portion, said central portion being in said well and said push rod being carried on said central portion, said first and second lateral ends being in contact with said first and second electrical terminals, respectively, when said plug is not in said socket whereby electrical current flows from said first electrical terminal to said second electrical terminal through said conductive spring, and, when said plug is inserted into said socket, said plug pushes said push rod into said well, thereby pushing said central portion of said conductive spring deeper into said well so that said first and second lateral ends are drawn away from said first and second electrical terminals, whereupon electrical current flows through said first and second wires and through said electrical load;

wherein said well has an upper, larger dimensioned portion and a lower, reduced dimension portion defining a shoulder where said larger dimensioned portion meets said reduced dimension portion, and wherein said push rod has a flange, said flange being dimensioned to fit into said larger dimensioned portion but not said reduced dimension portion so that said shoulder acts as a stop for said push rod when said bulb holder is inserted into said socket.

* * * * *